US006405903B2

(12) United States Patent
Stadelhofer

(10) Patent No.: US 6,405,903 B2
(45) Date of Patent: Jun. 18, 2002

(54) MEDIA DISPENSER

(75) Inventor: Peter Stadelhofer, Singen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/814,499

(22) Filed: Mar. 22, 2001

(30) Foreign Application Priority Data

Mar. 30, 2000 (DE) ..... 100 15 968

(51) Int. Cl.[7] ..... B65D 83/00
(52) U.S. Cl. ..... 222/309; 222/321.8; 222/385
(58) Field of Search ..... 222/305, 307–309, 222/321.1, 321.2, 321.3, 321.5, 321.6, 321.7, 321.8, 321.9, 382.1, 383.3, 385

(56) References Cited

U.S. PATENT DOCUMENTS 4,694,976 A * 9/1987 Schuetz ..... 222/385
4,871,092 A 10/1989 Maerte
4,958,752 A * 9/1990 Maerte et al. ..... 222/385
5,277,334 A * 1/1994 Malinconico ..... 222/321.8
5,375,745 A * 12/1994 Ritsche ..... 222/321.1
5,411,181 A 5/1995 Knockerbocker ..... 222/309
6,059,151 A * 5/2000 Fuchs ..... 222/321.6

FOREIGN PATENT DOCUMENTS

| | | |
|---|---|---|
| DE | 79 01 055 | 4/1979 |
| DE | 32 25 910 | 1/1984 |
| DE | 297 17 036 | 3/1999 |
| DE | 100 15 968 | 10/2000 |
| EP | 0090 659 | 3/1983 |
| EP | 0 090 659 | 10/1983 |
| GB | 2042630 | 2/1983 |

* cited by examiner

*Primary Examiner*—J. Casimer Jacyna
(74) *Attorney, Agent, or Firm*—Quarles & Brady LLP

(57) ABSTRACT

A dispenser (1) comprises setting means (10) for varying the discharge stroke (9) or discharge volume. The setting means (10) act on a valve (20). The associated valve face (24) of valve (20) can be linearly shifted to thus ensure very safe function.

25 Claims, 6 Drawing Sheets

MEDIA DISPENSER

TECHNICAL FIELD AND BACKGROUND OF THE INVENTION

The invention relates to a dispenser with which media can be stored, delivered or discharged. The media can be liquid, pasty, gaseous, powdery and/or solid. The dispenser is held and actuated single-handedly by the user while discharging. The dispenser is made partly or completely of injection-molded or plastics parts, each of which may be dimensionally rigid, elastic or flexible without strain. The dispenser may be designed for discharging either only once a single dose or for sequentially discharging separate doses of the medium. The discharge stroke to be implemented for this purpose may be provided in a single direction only or may follow a return stroke by which a metering or pump chamber is refilled with the medium after discharge.

The actuator provided for controlling the dispenser, such as for opening outlet paths, closing inlet paths, triggering a discharge drive or for manually driving a discharge stroke determines an activation degree which may be the path of the cited opening or closing action or the stroke and also the volume of the medium as conveyed in a single discharge action within the dispenser or as ejected therefrom. This avtivation degree is variable, particularly to satisfy the various conveying properties of the medium or for varying the medium dose. For controlling the flow of the medium through the dispenser a closure is provided which may be capable only for opening or only for closing. The closure may also be a reversibly opening and closing valve.

The cited variation in the activation degree may be solely determined for being set within a given range when assembling the dispenser parts to form the dispenser. Instead it may also be provided to be varied by the user after assembly of the dispenser in one direction or in opposing directions. Where the dispenser includes a pump, such as a thrust piston pump the positioning or setting means may variably define the rest position or return stroke position of the pump piston by an abutment. Then the setting means include a stop adjustable in opposing directions parallel to the piston stroke. Against this stop the piston is abutted on the return stroke. In this arrangement the advance stroke of the piston is likewise limited by a stop. The valve may be a destructable closure or an inlet or outlet valve for a chamber such as the pump chamber.

OBJECTS OF THE INVENTION

An object of the invention is to provide a dispenser which avoids the disadvantages of known configurations. Another object is that the actuator or setting means act on the valve so that its control can be influenced thereby. A further object is that the dispenser is simple in configuration and handling as well as safe in function.

SUMMARY OF THE INVENTION

In accordance with the invention the setting means may act so that the mutual position of the valve elements remains the same in one or both end positions of the valve irrespective of the setting by the setting means. As a result the functions of the valve remain constant. The valve may be an outlet, inlet or pressurizing valve or a slide respective sled or one such valve whose valve faces are positionally fixed by mutually abutting in one or both end positions. The valve may be controlled purely as a function of the path or as a function of the medium pressure. The valve is translated into the one end position manually or into the other end position by a spring. The communicating or valve passage may be constricted only down to a narrowest degree whilst still being permeable or it may be closed off totally.

The configuration in accordance with the invention is also of advantage for dispensers in which the setting means do not effect the valve or which do not include a valve but a sled determining the activation degree. Thereby while setting the sled executes no, or merely a minor, rotating motion and, where necessary, is powered via an intermediate gear or gear chain including a drive member such as a rotating member. This sled is prevented from rotating by a guide which may be shaped linearly or helically or steeply helically.

The design in accordance with the invention is also suitable for dispensers in which a setting member of the setting means, particularly a pitched or threaded member, is integral with the base body which in turn is in one part from this setting member up to at least one of a hermetically sealed dry chamber, a vent opening traversing the base body, a piston track, a medium chamber, an inlet valve or a connection for a riser tube.

Expediently the housing also directly or integrally mounts a support flange with which the base body can be tensioned against a support such as a finger rest or a medium reservoir. The support flange may be shaped in the form of an annular disk or a cap. The flange is located between and spaced from both ends of the one-part housing. Thus a compact design including few separate components is achieved.

The finger rest or handles for actuating the setting means may freely protrude in the flow direction or may be overlappingly or spacedly offset relative to the associated gear member in the setting direction. Thus the handle is always just as accessible in any position of the setting means or changes its position relative to the base body either not at all or to a lesser extent than the setting means when being set.

For actuation the dispenser advantageously comprises an actuating or discharge head including a finger rest or a medium outlet. The head engages the setting means and may permanently protrude into the interior of a setting member of the setting means. This setting member may also permanently protrude into the interior of the head so that corresponding coverings are formed to prevent dirt ingress.

In another aspect the setting means comprise a separate seal which as a sliding seal seals off a base body, the dry chamber not charged with the medium, or the like.

These and further features of the invention as apparent from the description and the drawings may provide subcombinations in an embodiment of the invention and in other fields and may represent advantageous aspects.

BRIEF DESCRIPTION OF THE DRAWINGS

Example embodiments of the invention are explained in more detail in the following and illustrated in the drawings in which.

DETAILED DESCRIPTION

Figure 1:
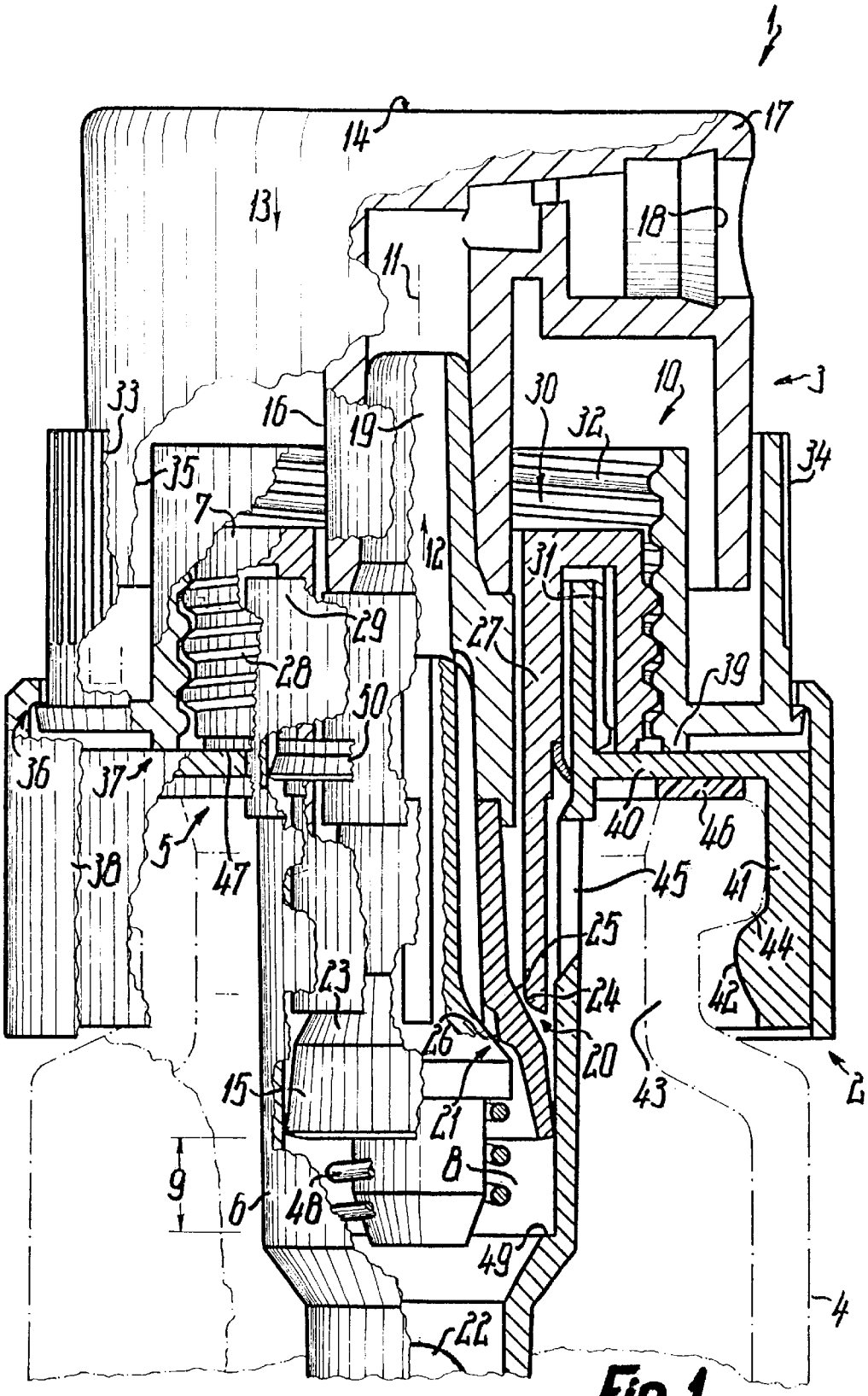
FIG. 1 illustrates a dispenser according to the invention in the initial or rest position in a view which is partly in section.

The dispenser according to FIGS. 1 to 6 includes a stationary unit 2 and a unit 3 movably mounted on unit 2 by a degree of activation, namely a stroke. Unit 2 is rigidly secured to a support or medium reservoir 4 projecting beyond it. Unit 2 comprises an integral base body 5 deeply protruding as a housing 6 into reservoir 4 and closed off outside of reservoir 4 by a hollow cover 7. Within reservoir 4 the housing 6 bounds a metering or pressure chamber 8 which is volumetrically variable by the stroke 9 of unit 3.

The volume of chamber 8 is additionally variable independent from the discharge actuator by setting means 10. Substantially all dispenser parts are located in a common center axis 11. From reservoir 4 or chamber 8 and on discharge the medium flows in direction 12 parallel to axis 11 away from reservoir 4 or outwardly. For this purpose unit 3 needs to be actuated in the opposite direction 13 or shifted relative to unit 2 in shortening the dispenser 1 by a finger rest or handle 14 which is to be manually pressed by a finger. At one end chamber 8 is bounded by a hollow piston 15 which sealingly slides on the inner circumference of single-walled housing 6.

Piston 15 and cover 7 are traversed by a ram 16 which carries at its outer end a discharge and actuating head 17. Ram 16 is composed of a train of three ram bodies, the outermost of which is made in one part with head 17 while the innermost protrudes via piston 15 into chamber 8. Piston 15 and the two outer ram bodies are traversed by an outlet duct 19 which ends in a medium outlet 18 at the circumference of head 17. Outlet 18 may be configured for dispensing droplets or a bundled jet or an atomized aerosol of the medium. A nozzle element including a swirler may be provided for this purpose and inserted in head 17.

The dispenser 1 has several valves 20 to 22, namely a valve 20 for venting reservoir 4, an outlet valve 21 for controlling transfer of the medium from chamber 8 into duct 19 and an inlet valve 22 opposite piston 15 for controlling the transfer of medium from reservoir 4 into chamber 8. Valves 20, 21 comprise a common valve body 23 formed by the hollow integral piston sleeve and directly adjoining the piston lip thereof in direction 12. The movable valve face 25 of valve 20 is located on the outer circumference of piston 15 and opposes a stationary valve face 24. Movable valve face 26 of outlet valve 21 is located on the inner circumference of piston 15 and nearer to the piston lip than to valve face 24.

On the return stroke of unit 3 in direction 12 the inclined or conical valve face 25 sealingly closes by abutting on face 24. Thus the rest position of the dispenser as shown in FIGS. 1 to 6 is determined. Face 24 is formed by the free end of a sleeve-shaped limiter 27 which freely protrudes between the shell of housing 6 and ram 16 into housing 6 and guides the outer circumference of ram 16. Limiter 27 is fixedly or integrally connected to a setting member 28 which covers the outer circumference of the open rim 29 of housing 6 or forms with the limiter 27 an annular groove into which housing rim 29 freely protrudes without any threaded engagement. Coaxial shells 27, 28 are components of cover 7 and positively prevented from rotating relative to base body 5 by a guide 31 on the inner circumference of setting member 28 thus forming a sled 30.

Via a gear chain or pitch members, such as threads, the setting member 28 engages cover 7. Setting member 28 in this arrangement includes the male thread and the sleeve-shaped setting member 32 the female thread. Thus, after all dispenser parts have been assembled and prior to mounting head 17 the cover 7 is to be brought into its mounting position in direction 13 through setting member 32.

The integral setting member 32 comprises an outer shell 33 enveloping the inner shell with a spacing. Shell 33 surrounds the outer circumference of head 17 also in the rest position, freely protrudes in direction 12 beyond the inner shell and has on the outer circumference a knurling to provide the finger rest or handle of the setting means. Shell 35 of head 17 freely protrudes in direction 13 into the annular groove between the inner shell and outer shell 33. Shell 35 thus can abut on the groove bottom at the stroke end and after valve 21 has opened. Relative to the base body 5 the rotary member 32, 34 is positively prevented from moving in direction 12 by an axial mount 36 and from moving in the direction 13 by an axial mount 37. Axial mount 36 comprises a mounting element 38 which surrounds housing 6 at the outside of reservoir 4 and overengages at one end a slide lip by an annular rim oriented inwardly. The slide lip protrudes beyond the outer circumference of the inner end of shell 33 in the region of an annular end wall which integrally connects shells 32, 33. Mount 37 includes a mounting element 39 annularly protruding beyond the end wall of setting member 32 in direction 13. Element 39 slides directly on the base body 5.

Base body 5 is fixedly or integrally connected to an annular disk-shaped flange 40 which is spaced from and located between the ends of housing 6. Flange 40 juts from the outer circumference of housing 6 and is located within element 38 or extends up to the inner circumference thereof. Mounting element 39 slides on the outer end face of flange 40. A shell 41 integrally adjoins flange 40 and projects only in direction 13. For tensioning flange 40 against reservoir 4 shell 41 has at its inner circumference positively connecting members 42, e.g. radially resilent snap cams. The neck 43 of reservoir 4 comprises at its end a bead 44 protruding radially outwardly and which under tension is backwardly engaged by members 42. Thus flange 40 is tensioned in direction 13 against the end face of neck 43 with an annular seal 46 inserted inbetween. Housing 6 protrudes through neck 43 into reservoir 4 by the majority of its length.

On the outer circumference as well as spacely between the ends of limiter 27 the shell of housing 6 is traversed by a venting port 45 porting against the inner circumference of neck 43 as well as being internally covered by limiter 27 and surrounded on the outside by shells 38, 41. Valve 20 opens already on commencement of the stroke in direction 13. Air is then able to flow through head 17 between ram 16 and limiter 27 in direction 13 against valve face 25 as well as through between valve faces 24, 25. Thereafter the air is deflected in direction 12 onto the outer circumference of limiter 27 and then guided through venting port 45 directly into reservoir 4. The pressurizing paths and the limiter 27 are thus located in a dry chamber not in contact with the medium. This dry chamber is sealed from chamber 8 only by the piston lip. When an overpressure exists in reservoir 4 the air flows in the opposite direction.

The bottom of reservoir 4 forms a further finger rest or handle facing away from handle 14. Both handles can be squeezed together by the fingers of one hand. Thus in overcoming the force of a spring 48 unit 3 is moved in direction 13 and chamber 8 is constricted by piston 15. Spring 48 is located in chamber 8. The end of piston 15 then abuts an inner shoulder 49 of the shell of housing 6 whilst ram 16 is moved further. This results in the neck of piston 15 located behind the piston sleeve being elastically squashed and the valve face 26 being unseated or lifted from the counter face. This face is formed by a core piece of ram 16. The core piece traverses piston 15 and centers spring 48. The core piece can urge inlet valve 22 into its closed position at the end of the stroke. Instead of this valve face 26 may be opened in the same way also by a correspondingly high pressure in chamber 8 before the stop or shoulder 49 is attained.

The medium then flows from chamber 8 through longitudinal grooves of outlet duct 19. The grooves are provided in the outer circumference of the core piece. The medium then further flows through the central outlet duct 19 and thus through head 17, until the medium gains access transversely deflected into the nozzle element of the atomizer nozzle and then emerges into the open from outlet 18. As soon as this advance stroke commences the stop or valve face 25 is also unseated from counter or valve face 24. Thus valve 20 is opened to pass air in one of the two directions cited. After the advance stroke the finger rests are released as a result of which spring 48 first closes valve 21 before then returning unit 3 into its rest position until valve faces 24, 25 abut on each other.

By rotating finger rest 34 the cover 7 or sled 30 is optionally shiftable in direction 12 or direction 13. Thus the counter stop or valve face 24 is adjusted relative to base body 5. Shown in FIG. 1 is with regard to direction 13 the frontmost end position of sled 30 corresponding to the shortest-possible stroke 9 of piston 15. When setting member 32, 33 is then rotated in the corresponding direction the sled 30 is moved together with piston 15 or unit 3 in direction 12. Thus the maximum-possible stroke 9 is correspondingly increased. The discharge volume can thus be increased e.g. from a minimum of 60 to a maximum of 150 $\mu$l or vice-versa continuously reduced. At the largest stroke the sled 30 may then protrude upwards out of the setting shell 32 and into head 17.

At the smallest stroke the sled 30 abuts directly on base body 5, namely against the outer end face of flange 40 by a stop 47 formed by the lower end of setting member 28. In the other end position the sled 30 is positively stopped correspondingly, namely directly by base body 5 or by rotating piece 32, 33 which as a counter stop may comprise a suitable snap ring. Although at the largest stroke the thread 28 may protrude upwardly out of setting member 32, its female thread still engages by at least a third or half of its length the male thread. Stop 47 is located directly adjacent to and within mounting element 39. Axial mount 36 is located radially outside of mounting element 39.

Sled 30 is sealed off relative to base body 5 by a slide seal 50. Seal 50 is an annular sleeve mounted in direction 12 onto the outer circumference of limiter 27 and thereby abutted on a shoulder. Seal 50 is in snug contact with the inner circumference of housing 6 and located downstream of port 45. At the smallest stroke the seal 50 is located in the plane of flange 40, from where seal 50 is able to slide along rim 29 in direction 12. Sleeves 15, 50 are made of a resiliently pliant material whilst all other plastics parts are dimensionally rigid in operation. Seal 50 prevents medium from weeping from chamber 8 into guide 31 or into the thread engagement when the dispenser 1 is oriented horizontal.

Element 38 surrounds tensioning shell 41 snugly or radially tensioned. Thus these two parts are fixedly interconnected in preventing cam 42 from disengaging due to radial widening of shell 41. Additionally, shell 41 is covered by mounting element 38 over its full length as with a shield. It is also possible to provide resilient latching means which lock rotating piece 32, 33 non-positively in various rotated positions so that each latched position can be overcome by a correspondingly high actuating force exerted on handle 34. The interengaging latch elements could be provided e.g. on the rotating piece and on base body 5 or flange 40 or on mounting element 38. Means for indicating the volume set in each case may also be provided. Indicator members thereof are movable relative to each other and are expediently provided on the rotating piece and on mounting element 38. For example, mounting element 38 then comprises in the region of mount 36 at the outer circumference or at its endface and around axis 11 a scale to which a marking is assigned on the outer circumference of shell 32.

Figure 2:
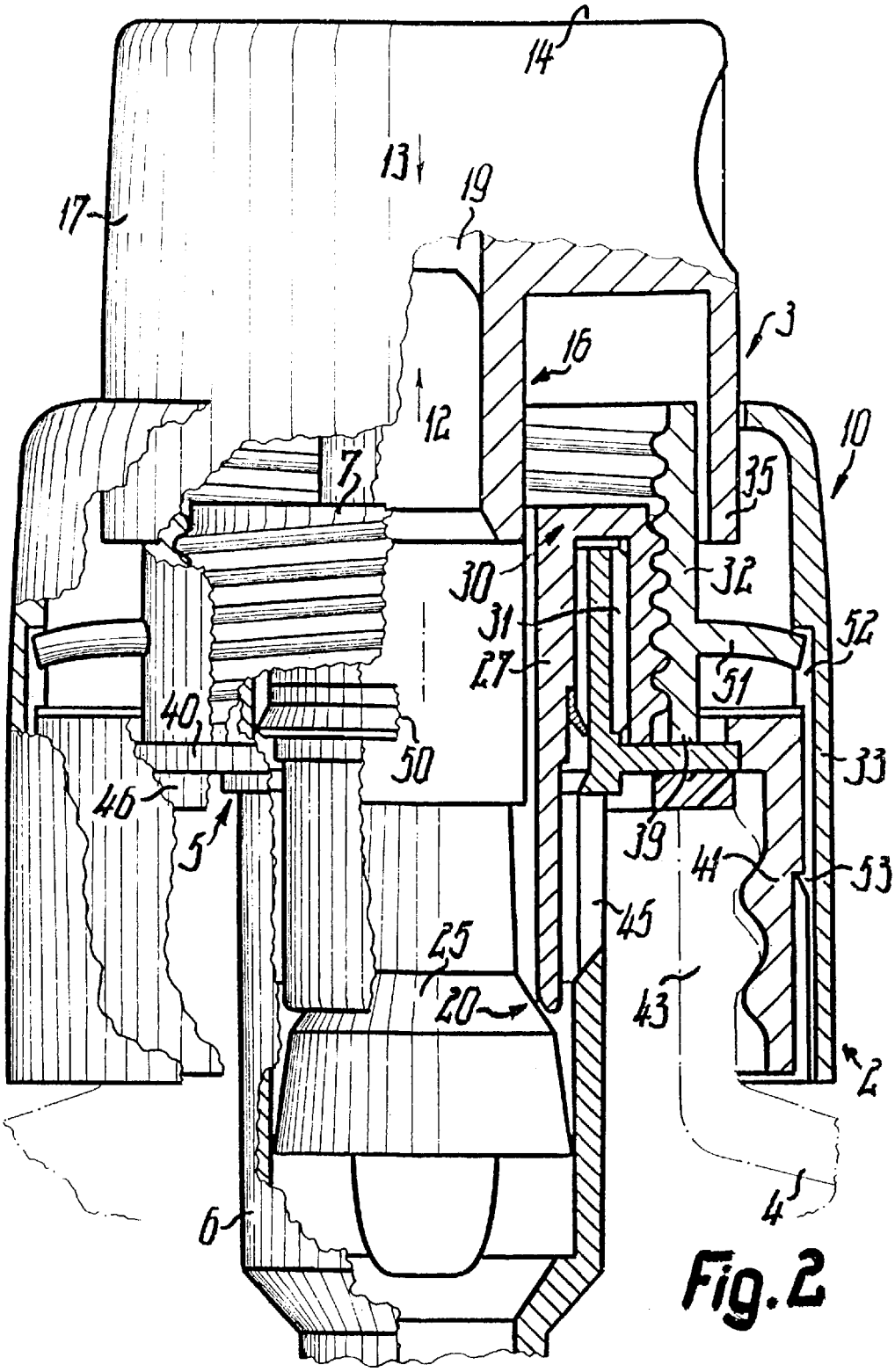
FIGS. 2 to 6 are partly sectioned views of further example embodiments as shown in FIG. 1.

FIG. 2 illustrates shell 33 as a component separate from shell 32 and axially shiftable relative to shell 32 but positively connected to shell 32 in the rotating direction by interengaging members. These members comprise cams 51 protruding from the outer circumference of shell 32 and recesses in the inner circumference of shell 33 engaging the ends of cams 51. Cams 51 are axially resilient and permanently tensioned so that mounting element 39 is permanently tensioned against flange 40. Shell 33 surrounds both the tensioning shell 41 full-length and also header shell 35 so that a very smooth outer surface results. Head 17 could also be positively prevented from rotating relative to base body 5 or sled 30, e.g. by a guide corresponding to guide 31. In this case the scale or the pointer marking of the indicator device could be provided on the circumference of head 17.

As apparent, flange 40 and tensioning shell 41 are formed by separate components. Tensioning shell 41 is part of a screw cap which radially outside of mounting element 39 tensionally contacts the same end face of flange 40 and which engages a male thread of neck 43 by a female thread. It is with this flange cap that via a resilient snap connector 53 shell 33 is axially positively connected with regard to both directions 12, 13 but with a slight clearance. For this purpose interengaging snap members are provided on the outer circumference of shell 41 and on the inner circumference of shell 33 which upon inherent resiliency interengage when shell 33 is mounted in direction 13. The snap members then still permit shell 33 to rotate relative to shell 41. Thus the rotating piece is permanently highly reliably mounted but nevertheless easily to be rotated.

Figure 3:
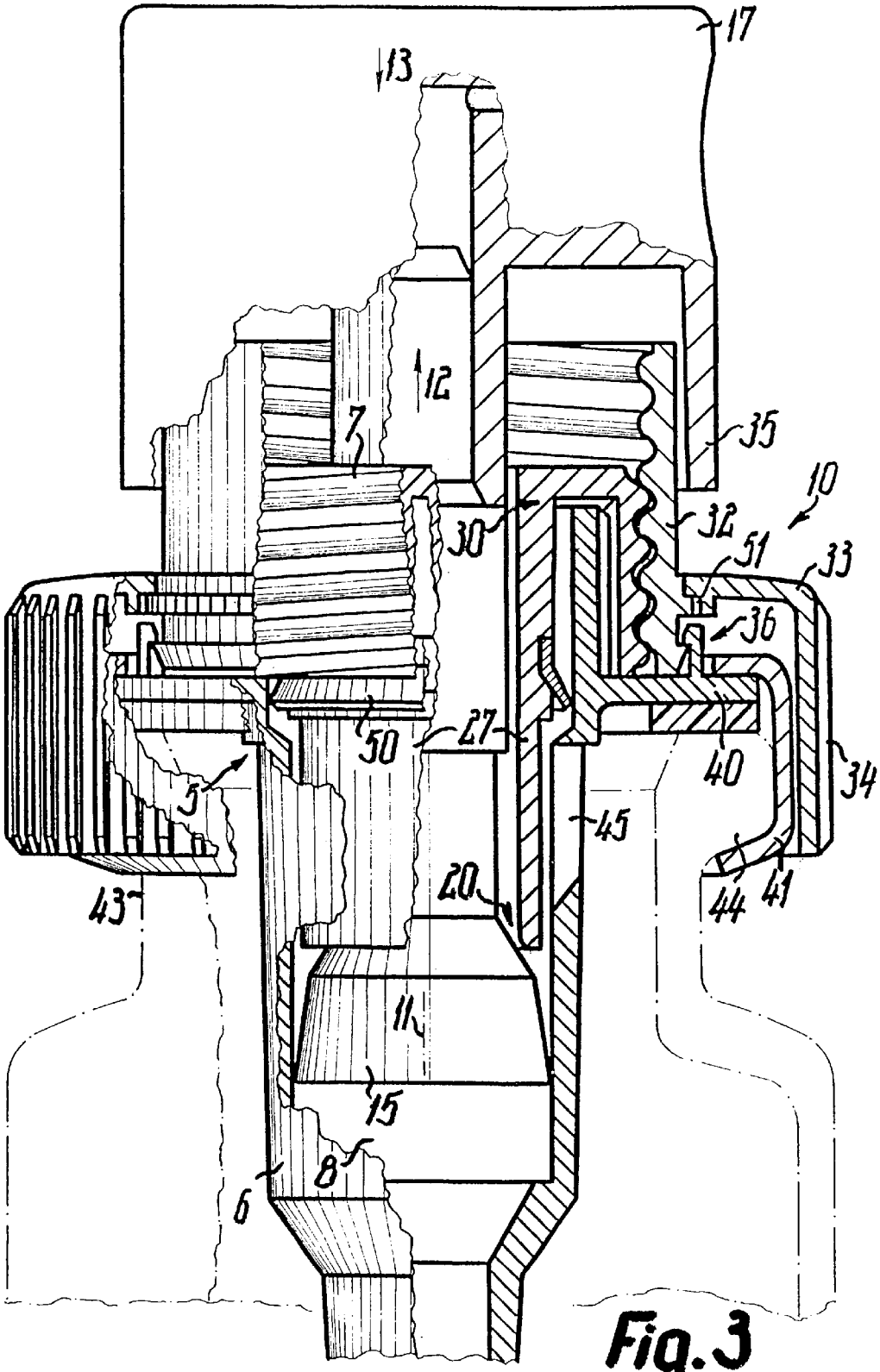

Like in FIG. 2 also in FIG. 3 shell 33 is cap-shaped so that it simultaneously forms element 38 according to FIG. 1 whilst being permanently axially spaced from head 17 or shell 35. The tensioning shell 41 is formed by a metallic crimp ring comprising ring ends bent radially inwardly and tensioned in contact with flange 40 and bead 44. Bearing 36 is located in the space between flange 40 and the end wall of outer shell 33 whereby one of its mounting members is directly formed by base body 5 or flange 40. The members of the mount 36 are configured as resilient snap members which automatically snap into mutual engagement when setting member 32 is introduced in direction 13. For this purpose the mounting member of flange 40 freely protrudes as a jacket in direction 12 from the associated end face. Setting member 32 comprises at the outer circumference a toothing 51 positively non-rotatingly engaging shell 33 by its corresponding inner toothing. This inner toothing is located on the inside of the end wall of shell 33. This end wall directly opposes header shell 35.

Figure 4:
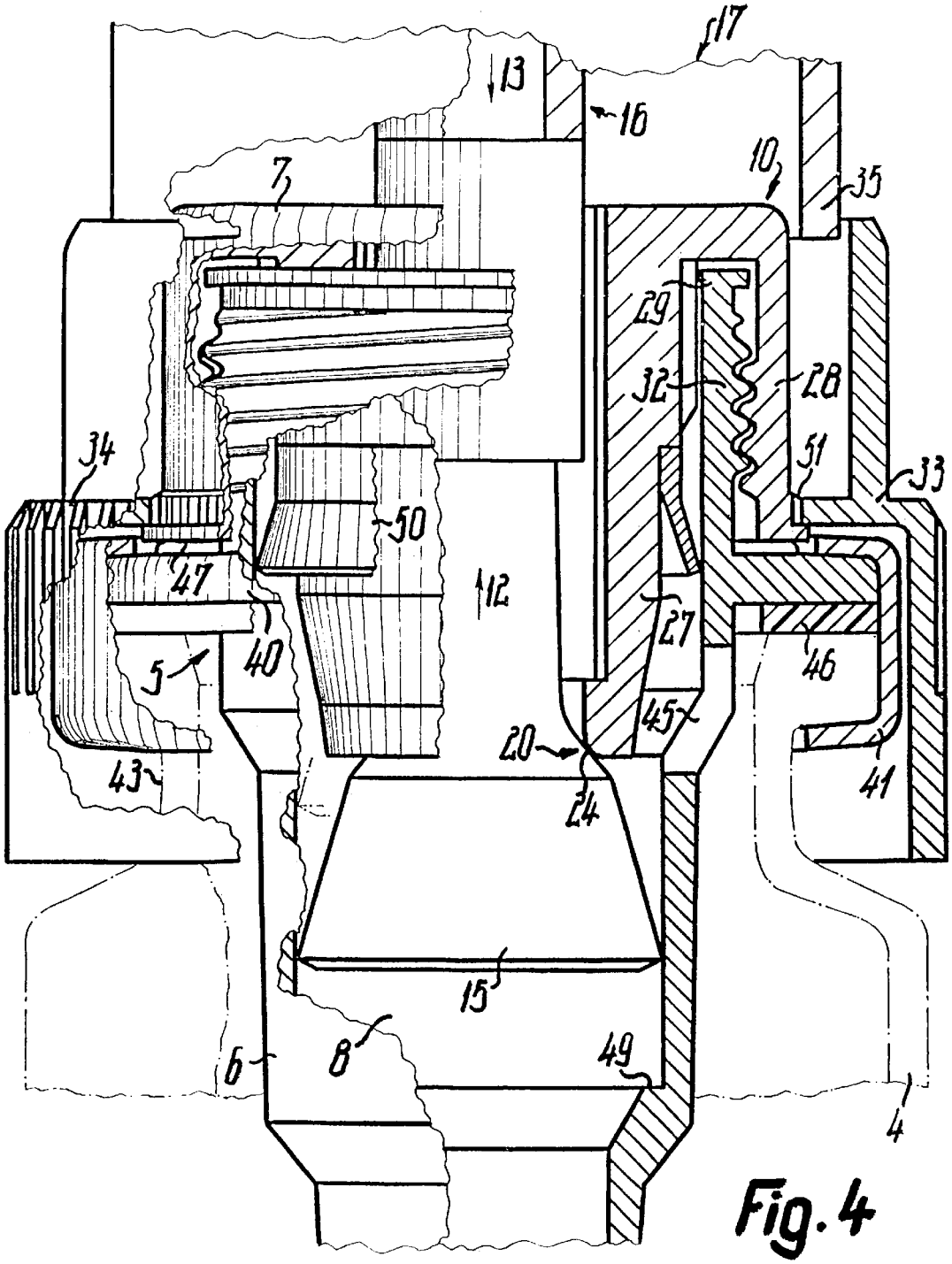

Also in the embodiment of FIG. 4, the pump, namely base body 5 including cover 7, piston 15, the core element and the thereto connected ram section, can be fixed to reservoir 4 by fastener 41. Thereafter shell 33 is to be mounted and brought into engagement with rotary connection 51. In this arrangement shell 33 comprises a shell section protruding beyond its end wall in direction 12. This shell section is narrower than handle 34 and surrounds shell 35 the same as shown in FIG. 1. Setting member 32 in this case is directly formed by base body 5, namely by a male thread on housing rim 29. The male thread engages setting member 28 by its female thread. Thus cover 7 is rotated relative to base body 5 by handle 34 and is axially shifted during this rotation. At the minimum stroke stop 47 abuts on ribs circumferentially distributed on the end face of flange 40. At the upper end the male thread or housing rim 29 may comprise a protuberance which limits the extent of unscrewing setting member 28 and which is resiliently overcome by the female thread when screwed in.

Figure 5:
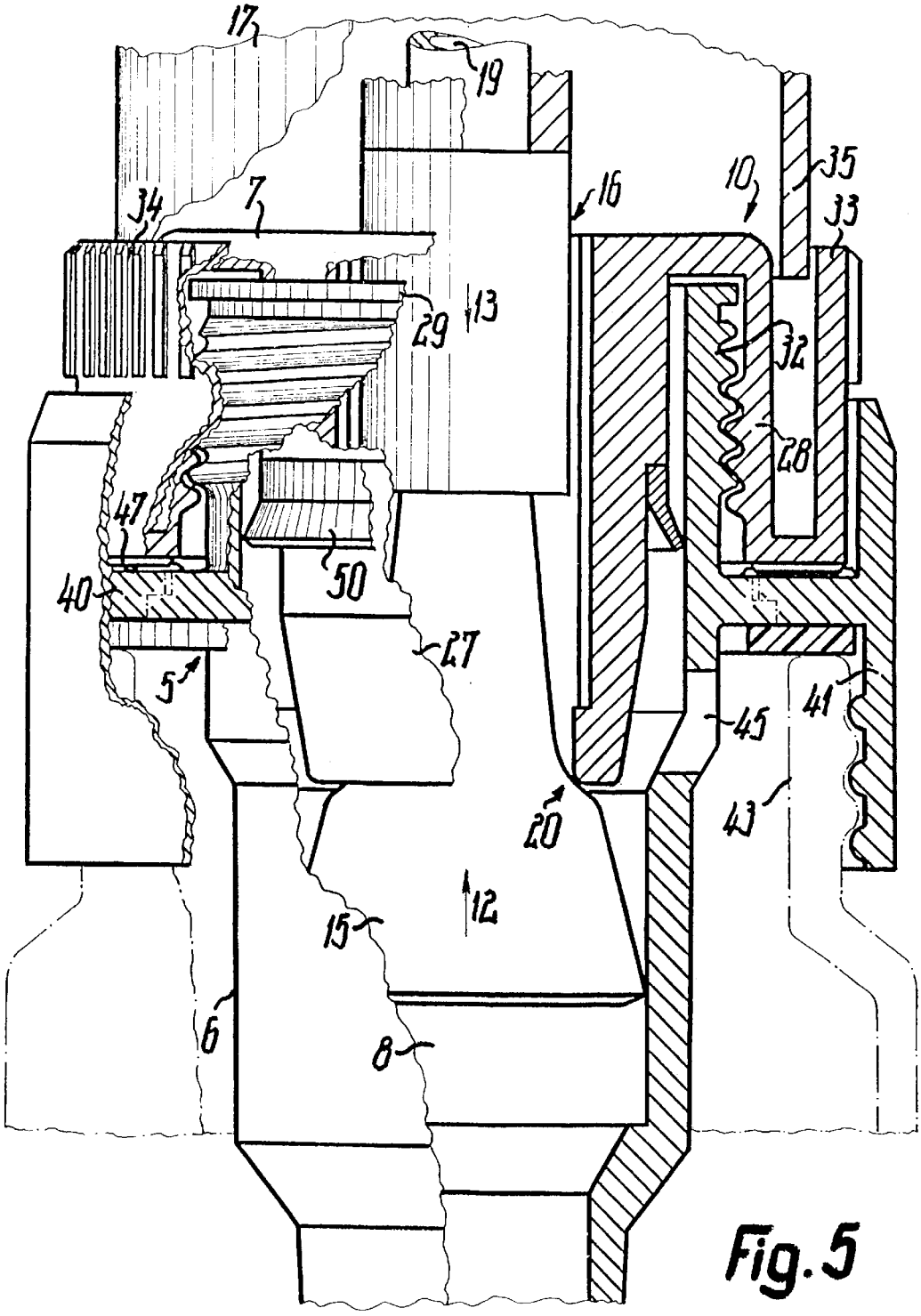

According to FIG. 5 cover 7 is in one part with outer shell 33 which with setting member 28 forms the groove engaged by shell 35. Shell 41 protrudes beyond flange 40 in direction 12 and surrounds outer shell 33 up to handle 34. In this arrangement shell 41 may be in one part with base body 5 or flange 40 or, as indicated dot-dashed, it may be formed by a separate component. In this case base body 5 and shell 41 form coaxially nested ring sections of flange 40 which form common, step-free and smooth end faces. The ring sections contact seal 46 in the region of their interconnection. In the associated end position they also contact the annular end wall of cover 7. This end wall interconnects shells 28, 33. The flange section of shell 41 positively urges the flange section of base body 5 in direction 13 since the connection comprises corresponding stepped annular surfaces. The dispenser as shown in FIG. 5 requires remarkably few single parts.

Figure 6:
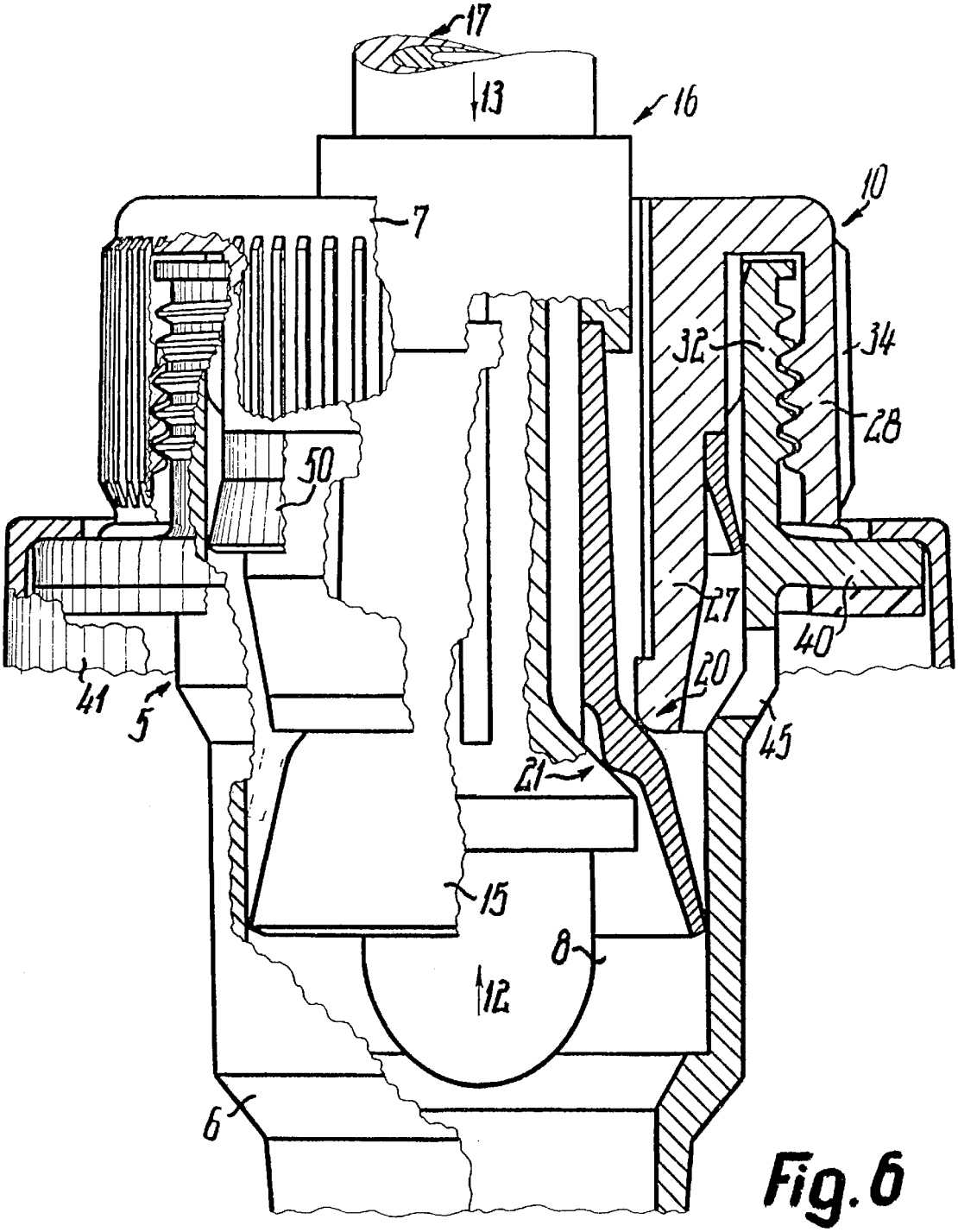

According to FIG. 6 the handle 34 is formed directly by the outer circumference of setting member 28. In this case, like handle 34 also member 28 is freely exposed to be accessible over its full-length. Member 28 may protrude up into shell 41. Handle 34 may also be lockable so that displacement can only be made when this lock has been released. For example, head 17 or its shell 35 may overengage handle 34 and shell 41 at their outer circumferences. Handle 34 is then not accessible for actuation until head 17 has been removed from ram 16. This feature is intended to prevent the user himself from tampering with the discharge volume as preset by an authorized person. Each embodiment may comprise all features of any other embodiment. Like parts are identified by like reference numerals in all Figures and thus the description applies accordingly to all embodiments. All cited features and properties may be provided precisely as described, or merely substantially or approximately so and may also greatly deviate therefrom, in view of the specific requirements.

What is claimed is:

1. A dispenser for media comprising:

a base body (5);

actuating means for controlling inherent motion of said dispenser (1) over an actuating path extending between end positions;

setting means (10) for varying said inherent motion, and a valve (20, 21, 22) for controlling flow of a medium by varying valve states, wherein positioning of said setting means (10) varies said valve states of said valve (20) said setting means (10) including a sled (30) determining characteristics of said inherent motion said sled (30) incorporating a valve face (24) of said valve (20).

2. The dispenser according to claim 1, wherein said sled (30) is drivingly connected to a rotary setting member (32).

3. The dispenser according to claim 2, wherein said rotary setting member (32, 24) is rotatable relative to said sled (30).

4. The dispenser according to claim 1, wherein a guide (31) is included for preventing said sled (30) from freely rotating relative to said base body (5).

5. The dispenser according to claim 1, wherein said sled (30) protrudes out of said base body (5).

6. The dispenser according to claim 1, wherein said sled (39) closes off said base body (5).

7. The dispenser according to claim 1 and further including a wall (29) with remote wall sides, wherein said sled (30) directly covers said wall (29) at said remote sides.

8. A dispenser for media comprising:

a base body (5);

actuating means for controlling inherent motion of said dispenser (1) over an actuating path extending between end positions;

setting means (10) for varying said inherent motion, and a valve (20, 21, 22) for controlling flow of a medium by (10) varying valve states, wherein positioning of said setting means (10) varies said valve states of said valve (20) said setting means (10) include a seal (50) separate from said valve (20), said seal (50) displacing relative to said base body (5) when said setting means (10) are being set.

9. The dispenser according to claim 8, wherein said seal (50) slides on said base body (5).

10. The dispenser according to claim 8 and further including a dry chamber barred from contact with the media, wherein said seal (50) sealingly closes said dry chamber.

11. A dispenser for media comprising:

a base body (5);

actuating means for controlling inherent motion of said dispenser (1) over an actuating path extending between end positions;

setting means (10) for varying said inherent motion, and a valve (20, 21, 22) for controlling flow of a medium by varying valve states, wherein positioning of said setting means (10) varies said valve states of said valve (20), a further valve (21) being included, said valve (20) and said further valve (21) including a common valve body (23), said valve (20) and said further valve (21) being traversed by valve passages bounded by said common valve body (23).

12. A dispenser for media comprising:

a base body (5);

actuating means for controlling inherent motion of said dispenser (1) over an actuating path extending between end positions;

setting means (10) for varying said inherent motion, and a valve (20, 21, 22) for controlling flow of a medium by varying valve states, wherein positioning of said setting means (10) varies said valve states of said valve (20), said valve (20) being a venting valve controlling a venting duct which traverses said base body (5).

13. The dispenser according to claim 12, wherein said venting valve (20) includes a valve passage bounded by opposing valve faces (24, 25), at least one of said valve faces (24) being positionally variable by said setting means (10).

14. The dispenser according to claim 12, wherein at least one of said valve faces (24, 25) limits said inherent motion.

15. The dispenser according to claim 12, wherein said valve faces (24, 25) directly contact each other in one of said end positions.

16. The dispenser according to claim 12, wherein said valve faces (24, 25) support on each other in a rest position of said dispenser (1).

17. The dispenser according to claim 12, wherein said valve faces (24, 25) are movable relative to each other for sealingly closing said valve passage.

18. The dispenser according to claim 12, wherein said valve passage is most constricted when said dispenser (1) is in one of said end position.

19. The dispenser according to claim 12, wherein said setting means (10) include a sled (30) determining characteristics of said inherent motion.

20. The dispenser according to claim 12, and further including a flange (40) radially protruding relative to said base body (5) and including an abutting stop, wherein said abutting stop limits setting of said setting means (10).

21. The dispenser according to claim 12, wherein said actuating means include an actuating head (17) engaging said setting means (10), said setting means (10) including a setting handle (34) protruding radially at least as far as an inner circumferential face of said actuating head (17).

22. The dispenser according to claim 12, wherein said actuating means include an actuating head (17) including a rim (35), said setting means (10) including a setting member (32) displaceable relative to said base body (5), said setting member (32) including a recess bounded by opposing flanks and a bottom, said rim (35) operationally engaging inside said recess.

23. The dispenser according to claim 12, wherein said base body (5) includes a housing including varying internal widths and a support flange (49), said base body (5) including a pitch member, said housing being made in one part, said base body (5) and said pitch member being commonly made in one part, said said pitch member also providing at least a portion of said setting means.

24. The dispenser according to claim 23, wherein said pitch member is a thread entirely and uninterruptedly extending over said actuating path (9).

25. A dispenser for dispensing a medium out of a medium reservoir comprising:

actuating means for operating the dispenser by an axial movement over an actuating path extending between two positions, including a rest position at a beginning of the actuation path and a final position at the end of the actuating path;

a pump cylinder and a pump piston moveable by said actuating means within said pump cylinder over said actuating path to bound a pump chamber;

valves including an outlet valve for the medium to be dispensed and a venting valve for connecting the medium reservoir to atmosphere in order to compensate pressure due to medium dispensed out of said reservoir;

a sleeve projecting into said pump chamber and cooperating with said pump piston to form the venting valve and to limit movement of the pump piston in said rest position; and setting means for amending an amount of said medium to be dispensed by varying the length of the actuating path by moving said sleeve within said pump cylinder, thereby adjusting the actuating path by adjusting the rest position of the pump piston in said pump cylinder without amending the final position of the pump piston within said pump cylinder.

* * * * *

UNITED STATES PATENT AND TRADEMARK OFFICE

CERTIFICATE OF CORRECTION

PATENT NO. : 6,405,903 B2
DATED : June 18, 2002
INVENTOR(S) : Peter Stadelhofer

It is certified that error appears in the above-identified patent and that said Letters Patent is hereby corrected as shown below:

Column 1,
Line 26, "avtivation" should be -- activation --;

Column 3,
Line 44: "the dispenser as" should be -- the dispenser 1 as --;

Column 7,
Lines 63-64, "said sled (39)" should be -- said sled (30) --;

Column 9,
Line 20, "said said pitch" should be -- said pitch --.

Signed and Sealed this

Twenty-second Day of April, 2003

JAMES E. ROGAN
*Director of the United States Patent and Trademark Office*